US007256804B2

(12) United States Patent
Reisinger

(10) Patent No.: US 7,256,804 B2
(45) Date of Patent: Aug. 14, 2007

(54) ARRANGEMENT AND METHOD FOR ACTIVATION OF A THERMOTRANSFER PRINT HEAD

(75) Inventor: Frank Reisinger, Oranienburg (DE)

(73) Assignee: Francotyp-Postalia GmbH (DE)

( * ) Notice: Subject to any disclaimer, the term of this patent is extended or adjusted under 35 U.S.C. 154(b) by 264 days.

(21) Appl. No.: 11/139,867

(22) Filed: May 27, 2005

(65) Prior Publication Data

US 2005/0270360 A1 Dec. 8, 2005

(30) Foreign Application Priority Data

Jun. 3, 2004 (DE) ..... 10 2004 027 517

(51) Int. Cl.
*B41J 2/38* (2006.01)

(52) U.S. Cl. ..... 347/186

(58) Field of Classification Search ..... 347/185, 347/186, 187; 400/120.08

See application file for complete search history.

(56) References Cited

U.S. PATENT DOCUMENTS

| | | | | |
|---|---|---|---|---|
| 4,449,136 | A * | 5/1984 | Moriguchi et al. | 347/186 |
| 4,510,507 | A | 4/1985 | Ishikawa | |
| 4,568,817 | A * | 2/1986 | Leng et al. | 347/186 |
| 4,705,417 | A | 11/1987 | Harry | |
| 4,746,234 | A | 5/1988 | Harry | |
| 5,019,836 | A * | 5/1991 | Iwata et al. | 347/182 |
| 5,610,649 | A | 3/1997 | Kokubo | |
| 5,712,671 | A * | 1/1998 | Ono | 347/186 |
| 5,838,356 | A | 11/1998 | Günther et al. | |
| 6,041,704 | A | 3/2000 | Pauschinger | |
| 6,351,220 | B1 | 2/2002 | Günther et al. | |
| 6,771,179 | B1 | 8/2004 | Post et al. | |
| 6,853,986 | B1 | 2/2005 | Rosenau et al. | |

FOREIGN PATENT DOCUMENTS

| | | |
|---|---|---|
| DE | OS 33 27 904 | 2/1984 |
| DE | OS 38 33 746 | 4/1990 |
| DE | 201 12 350 | 2/2002 |
| EP | 0 536 526 | 6/1992 |
| EP | 0 576 113 | 3/2000 |
| EP | 0 789 333 | 8/2003 |

* cited by examiner

*Primary Examiner*—Huan Tran
(74) *Attorney, Agent, or Firm*—Schiff Hardin LLP

(57) ABSTRACT

An arrangement for activation of a thermotransfer print head has a unit to determine a transport delay and a unit to generate supplementary heating pulses to maintain a temperature required for printing at the thermo-printing heating elements. The unit to determine a transport delay is connected with the thermotransfer print head via the unit to generate supplementary heating pulses. A method for activation of a thermotransfer print head includes the steps of determining a transport delay and generating supplementary heating pulses for maintenance of a temperature necessary for printing at the thermo-printing heating elements for which a printing requirement is present.

15 Claims, 5 Drawing Sheets

Strobe heating pulses
Encoder pulse sequence
Heating element temperature
delay Δt

ARRANGEMENT AND METHOD FOR ACTIVATION OF A THERMOTRANSFER PRINT HEAD

BACKGROUND OF THE INVENTION

1. Field of the Invention

The present invention concerns an arrangement for activation of a thermotransfer print head as well as a method for activation of a thermotransfer print head. The invention is particularly suited for use in franking machines, address machines and similar accounting or mail processing apparatuses.

2. Description of the Prior Art

The thermotransfer franking machine T1000 manufactured by Francotyp-Postalia has a thermotransfer print head, mounted fixed in a housing, for printing a franking imprint and a tray, externally attached to the housing, to accept an exchangeable thermotransfer ink ribbon cartridge. The tray encloses a non-secure region. A mail piece is moved through the printing station synchronized with the thermotransfer ink ribbon, the movement being monitored by a detector that generates an output signal representing a parameter proportional to the ribbon movement (European Application 18 92 69 equivalent to U.S. Pat. No. 4,705,417).

Although a door leading to the tray can be opened at any time, access to the secure region of the printing device is prevented by a security housing. Due to the security housing, no special security measures must be taken to protect the activation and data signals for the print head that allows a printing of fixed, semi-permanent and variable information (U.S. Pat. No. 4,746,234).

For the thermotransfer print head, it is known from German OS 05 38 33 746 to integrate an internal switching unit, charged via an external activation unit, into the print head that contains the thermo-printing heating elements in a single row, which enables a selective activation with pre-heating of the thermo-printing heating elements to reduce the heat output upon printing. The resistance heating elements are directly pre-heated to a pre-heating temperature with a clock frequency adapted (in terms of pulse amplitude and pulse width) to the necessary heat energy. At the end of the printing time, the pre-heating temperature is maintained with such a clock frequency.

A method for control of the feed of a thermo-printing heating element is disclosed in European patent 536 526 B1. A print requirement is determined in advance at the respective raster points in time of a predetermined print raster. An output of current pulses to the respective thermo-printing heating elements ensues both for the raster points in time without a print requirement and for the raster points in time with a print requirement. The current pulses (pre-heating pulses) (which are output according to a specific algorithm before a raster point in time with a print requirement) effect a pre-heating of the respective thermo-printing heating element up to a temperature just below a limit temperature at which a print point is delivered by a thermotransfer ink ribbon and is visible on a carrier material (mail piece). Pre-heating pulses cannot be output in a sequence that is too fast nor at intervals that are too large for the respective thermo-printing heating element, because otherwise the aforementioned limit temperature would be exceeded or undershot. In the first case, the print image appears too heavy and smeared. In the second case the print image is too thin and pale because by itself the main printing pulse effects only a short-term exceeding of the limit temperature at the raster point in time with a print requirement.

A method is also known wherein a predetermined pre-heating temperature is maintained in the printing pauses at the respective heating element by means of pre-heating and post-heating pulses (German OS 38 33 746).

A controller that, dependent on the print head temperature, influences the pulse width or amplitude of the heating pulses in order to achieve overheating protection is known from U.S. Pat. No. 4,510,507 and German OS 33 27 904.

A print head thermo-controller is disclosed in European Patent 730 972 wherein the power electronic associated with the print control unit regulates the amplitude of the print head voltage, corresponding to the environment temperature and is combined with a control unit that operates according to an anticipatory control algorithm for feeding individual thermo-printing heating elements with pre-heating pulses and printing pulses of variable pulse duration.

For such a franking machine, a method and arrangement for fast generation of a security imprint are disclosed in the European Patent EP 576 113. The method enables embedding of variable data during the printing of the security imprint, but this then allows only a brief projection to determine a print requirement.

Very high requirements are placed on a security imprint by some postal authorities, in particular with regard to its machine-readability and communications about auxiliary services of the postal carrier that can change from letter to letter. Since April 2004, Deutsche Post AG has promoted the launch of the first franking machines in Germany with a digital indicium "FRANKIT": (/www.deutschepost.de/download/broschueren/20403000_Frankit_Folder.pdf). The following are encrypted in a matrix code:

a) all specifications readable in plain text, such as date, postage value etc., b) information regarding the franking type, product code, current shipment number, machine identification and serial number, c) copy protection information.

Such a security imprint contains previously entered and stored postal information including the postal rate data for transport of the letter and, if applicable, a marking with security information. In modern franking machines, the accounting and storage of postal rate data (European Application 789 333) and internal security measures (U.S. Pat. No. 6,351,220, and German Utility Models 299 05 219, and 201 12 350) are implemented and the aforementioned security information are generated (German OS 199 28 058, U.S. Pat. No. 6,041,704) by a postal security module arranged inside the meter housing. The prior calculation of security information requires a majority of the time in the postal security module, and thus the security information is available for embedding into the print image only relatively late. Even a partial prior calculation of security information well before a franking by the franking machine can not prevent that the matrix code in the marking field from changing from mail piece to mail piece. This makes it more difficult to still determine a print requirement in advance in a timely manner. The printout of a machine-readable matrix code requires a higher number of raster points in time, corresponding to the higher print resolution, which is associated with a higher computing capacity. A requirement for a 25-50% faster mail piece transport also has a detrimental effect. The raster points in time follow one another in shorter intervals the higher the selected mail piece transport speed. If the thermo-printing heating elements are pre-heated by means of pre-heating pulses up to a preheating temperature up to relatively close to the aforementioned limit temperature without exceeding the latter, the maximum possible duration of the pre-heating pulses is limited by the reduced intervals between the successive main heating pulses. The (in practice controllable) maximum possible pre-heating pulse height is likewise limited. Conventional methods for thermotransfer printing control the temperature at the individual thermo-printing heating elements of the print head via the most varied methods. Given a high print image resolution and transport speed, the print image of the first print columns appears to be printed more faintly at the beginning of the printing than in the remaining print columns of a stamp imprint. Moreover, a wave-shaped repeating attenuation in the print pattern (Ratter effect) acts in an interfering manner in the remaining print columns the higher and more non-uniform the mail piece transport speed is during the printing. If a transport delay occurs for any reason, the resistance heating elements that generate the print image points (dots) cool, and given further printing a section of the print pattern is printed that appears somewhat fainter since the temperature is no longer reached. This can only then be adjusted again after more than one further print column has been printed.

SUMMARY OF THE INVENTION

An object of the present invention is to provide an arrangement and method for activation of a thermotransfer print head that does not exhibit the disadvantages cited above. Requirements for a higher print image resolution must be fulfilled, while suppressing the influence on the print image of fluctuations in the relative speed between the print medium and the print head, and the solution should entail only minor manufacturing costs.

The above object is achieved in accordance with the present invention by an arrangement for activating a thermotransfer print head having a number of thermo-printing heating elements, wherein an item on which information is to be printed by the print head is transported passed the print head, the arrangement including a unit to determine a transport delay in the transport of said items, and a unit to generate supplementary heating pulses to maintain the printing temperature at the thermo-printing heating elements, the unit to determine a transport delay being connected to the thermotransfer print head through the unit to generate supplementary heating pulses, so that the supplementary heating pulses are generated dependent on the determination that a transport delay has occurred.

Under specific circumstances, the individual thermo-printing heating elements of the print head exhibit a heat energy that is insufficient for printing in order to print dots on the print carrier surface (letter envelope, card, strips or other print media) in a machine-readable form, and the energy controller must be changed. In franking machines in which mail pieces are passed under a stationary print head at a transport speed, difficulties also occur due to the non-uniform thickness of the mail pieces. If the fault cited above can be corrected, the solution can be used in other printing machines. Therefore, when mail pieces are discussed below, this term encompasses all other print media or print goods as well. When postal requirements are subsequently discussed, all other possible requirements according to a higher print image should are encompassed as well. When franking machines are subsequently discussed, all other printing machines in which a print head is moved over a stationary print medium with a transport speed are encompassed as well.

Given the same mail piece transport speed and an interval of the print columns of a stamp imprint that is too large, the thermo-printing heating elements of the print head cool in the time between the printing of the print columns so much that an operating temperature at which the necessary printing temperature can no longer be achieved as quickly via pre-heating is under-run. Moreover, a cooling effect via the thermotransfer ink ribbon on the respective thermo-printing heating elements has been found that affects the print image given a higher mail piece transport speed since the pre-heating temperature is not maintained. However, when a thermo-printing heating element is not preheated by means of pre-heating pulses up to a preheating temperature relatively close to the aforementioned limit temperature, the necessary print quality is not maintained. For example, the print image created by the main heating pulse will appear thin and paler than is allowed. The cooling effect can be compensated only by a computer with a long-term increase in the mail piece transport speed. Given a short-term reduction of the mail piece transport speed, due to transport delay a cooling effect can likewise occur that, however, cannot be compensated by a computer, and therefore is prevented by a separate circuit arrangement which inserts short-term supplementary heating pulses for maintenance of the printing temperature into the activation of the respective thermo-printing heating elements.

The occurrence of a transport delay of the mail piece (by slowing down the rate of encoder pulses) is monitored during the printing. A transport delay can occur, for example, occur during a start-up due to binding the print medium. If a transport delay is detected, short supplementary heating pulses are supplied to the respective thermo-printing heating elements for which a print requirement exists and which have just been printed, these short supplementary heating pulses being supplied in the temporal gaps between successive print columns.

The length of the print pulses and the length of the pause between the print pulses are dependent on the resistance of the heating elements and the thermal behavior such as print voltage, melting point of the thermotransfer ink ribbon, print medium (packing material) of the mail piece and heat dissipation of the printing system and must be established corresponding to the respective usage case. The print quality is significantly improved because no faintly printed regions (which are created by speed fluctuations) occur any more. The arrangement contains a first unit to determine a transport delay and a second unit for generation of supplementary heating pulses to maintain a temperature necessary for printing at the thermo-printing heating elements. The first unit is connected with the thermotransfer print head via the second unit. The first unit to determine a transport delay include a counter that counts a number of clock pulses of a clock generator signal until the counter is reset. The first unit also includes an edge detector that prepares the undelayed and delayed encoder pulses into an encoder pulse sequence that characterizes an encoder pulse edge with an H/L and an L/H edge alternation with a narrow pulse, the counter being reset by the pulse. The first unit also includes logic for enabling the generation of supplementary heating pulses when a predetermined number of counted clock pulses are exceeded, an overrun occurs before the next encoder pulse edge alternation.

The method for activation of a thermotransfer print head includes the steps of determining a transport delay and generating supplementary heating pulses to maintain (at the thermo-printing heating elements for which a print requirement exists) a temperature necessary for printing.

The temporal interval of the raster points in time from one another is determined by the transport speed detected by means of encoder and the desired horizontal print resolution. This allows a determination of the transport delay in comparison with the temporal desired interval of the raster point in times. The determination of a transport delay is established using a missing encoder edge alternation before a CLK overrun of the counter or an excess of a predetermined counter state.

The supplementary heating pulses serve for the maintenance at the thermo-printing heating elements of a temperature necessary for printing, so that a transport delay of the printing of a dot is not ended before reaching a print column that should be printed at a predetermined raster point. The spatial separation of the raster points in the print pattern also remain constant. During the maintenance of a temperature necessary for printing, ink melts from the thermotransfer ink ribbon at the heated points and is transferred to the print medium surface, for example a mail piece.

The invention has the advantage that maintenance of the temperature at the thermo-printing heating elements for the printing of pixels can be achieved despite of a transport delay without using computing capacity.

DESCRIPTION OF THE PREFERRED EMBODIMENTS

Figure 1:
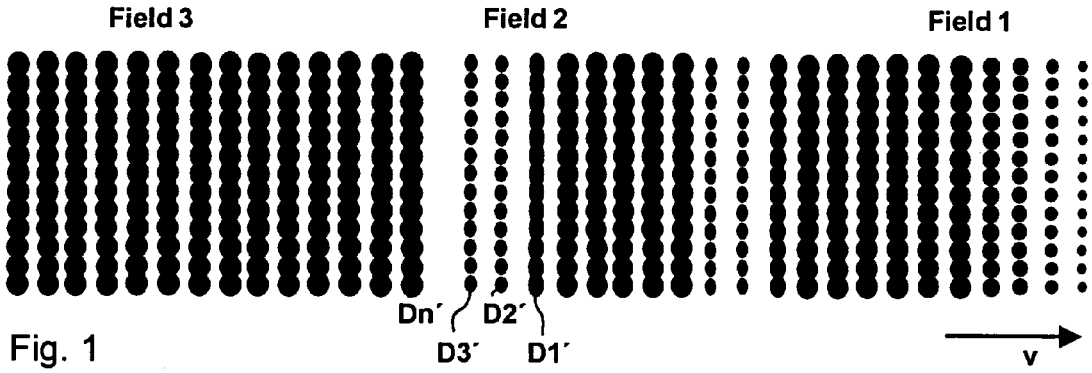
FIG. 1 shows single-color print pattern with spatially constantly separated raster points and faintly printed regions.

FIG. 1 shows a monochrome print pattern with spatially constantly separated raster points. For clarification, an initial degradation of the print pattern has been shown disproportionally visible in the first printed field 1, and the Ratter effect due to faintly printed regions has been shown disproportionally visible in the middle field 2. The print image points D1', D2', D3' and Dn' shown in the middle field 2 are a component of the grid-like print pattern and are explained in detail below.

Figure 2:
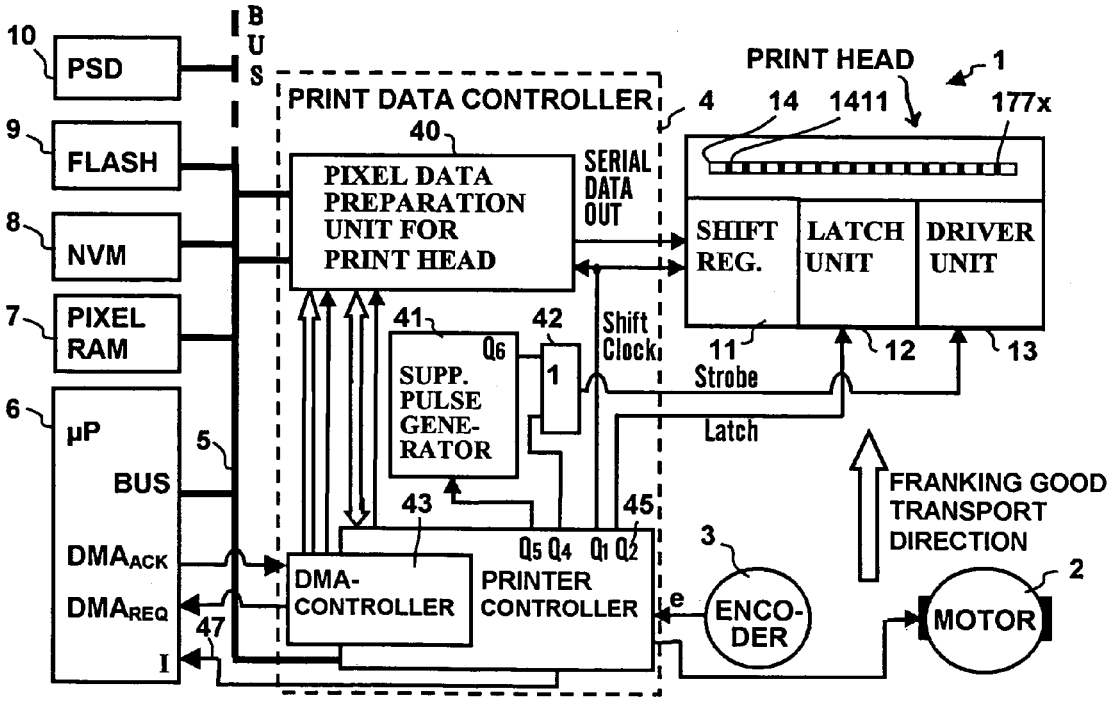
FIG. 2 is a block diagram for control of a thermotransfer printer in accordance with the invention.

A block diagram for control of a thermotransfer printer is shown in FIG. 2. The invention should be clarified in the example of a franking machine. A thermotransfer print head 1 is equipped with a shift register 11, a storage latch unit 12 and driver unit 13 as well as with a row 14 of thermo-printing heating elements 1411 through 177*x* disposed orthogonally to the franking medium transport direction. The thermotransfer print head 1 is connected via the shift register 11 with the serial data output of a print data controller 4, which (given a direct storage access) receives 16-bit parallel binary print image data from a BUS 5 on the input side and outputs serial binary print image data on the output side. At least one microprocessor 6, a pixel memory 7, a non-volatile memory 8 and a fixed value memory 9 are connected via the BUS 5 in terms of address, data and control. An encoder 3 is connected with the print data controller 4 in order to synchronously initiate the buffering of the binary pixel data and the printing of the print image columns. The print head is activated with a clock frequency that allows a transport speed of approximately 150 mm per second for up to 10 mm-thick mail pieces. The print data controller 4 is connected with a motor 2 to drive a conveyance device for mail pieces in the transport direction (white arrow).

A printer controller 45 is connected to a DMA controller 43, a pixel data preparation unit 40 and a supplementary pulse generator 41. The DMA controller 42 also is connected with the pixel data preparation unit 40. The pixel data preparation unit 40 is directly connected with the microprocessor 6 via the bus 5, and the printer controller 45 is directly connected with the microprocessor 6 via the bus 5 and via a control line 47 for an interrupt signal 1. The DMA controller 43 is connected with the microprocessor 6 via a control line for DMA control signals DMMCK, DMAREQ. Via output Q1, the printer controller 45 supplies a shift clock signal to the pixel data preparation unit 40 and to the shift register 11. Via output Q2, the printer controller 45 supplies a latch signal to the storage latch unit 12 to hold and secure the data. Via output Q5, the printer controller 45 supplies a start signal to the supplementary pulse generator 41 that emits a supplementary pulse signal at an output Q6 that is logically linked via a logical OR gate 42 with a strobe signal which is supplied by the printer controller 45 via output Q4. The output of the OR gate 42 is connected to a control input of the driver unit 13; both the strobe signal and the supplementary pulses that switch the switch of the driver unit 13 for activation of the thermotransfer print elements of the thermotransfer print head also can be supplied via this control input. The switches can be advantageously executed as AND gates or transistors. Latches of the storage latch unit 12 (which accepts and, with the latch signal, holds information for a pre-heating or print requirement of the respective pixel) is respectively associated with each switch or, respectively, AND gate or transistor. The serial/parallel shift register 11, loaded by the pixel data preparation unit 40 with the serial print data, transfers the print data to the storage latch unit 12 in a first activation phase. In a second activation phase, during a strobe pulse each gate of the driver unit 13 activated by the associated latch of the storage latch unit 12 is switched open and a heat current pulse is emitted to the respective thermo-printing heating element. The respective thermo-printing heating elements for which a pre-heating or printing requirement exists are immediately pre-heated by heat current pulses that are adapted to the required heat energy in terms of their pulse amplitude and pulse width.

The main control circuit board of a franking machine contains a security module 10 that is plugged in the circuit board directly or via an adapter. The security module 10 for a franking machine is subsequently designated as a PSD (postal security device). However, the PSD can be omitted for other application purposes or pure print jobs.

The main control circuit board of a franking machine moreover contains further interfaces (not shown), for example for connection of a keyboard and a display unit.

The unit to determine a transport delay during the printer is arranged in the printer controller 45. The supplementary pulse generator 41 serves to generate supplementary heating pulses for temperature maintenance at thermo-printing heating elements to prevent the Ratter effect. The entire print data controller 4 preferably can be realized by an application-specific circuit (ASIC) or programmable logic such as, for example, the FPGA of the series Spartan-II 2.5V by the firm XILINX (www.xilinx.com). Further information about field programmable gate array chips and connected technologies is provided in connection with FIG. 3*a*.

Figure 3A:
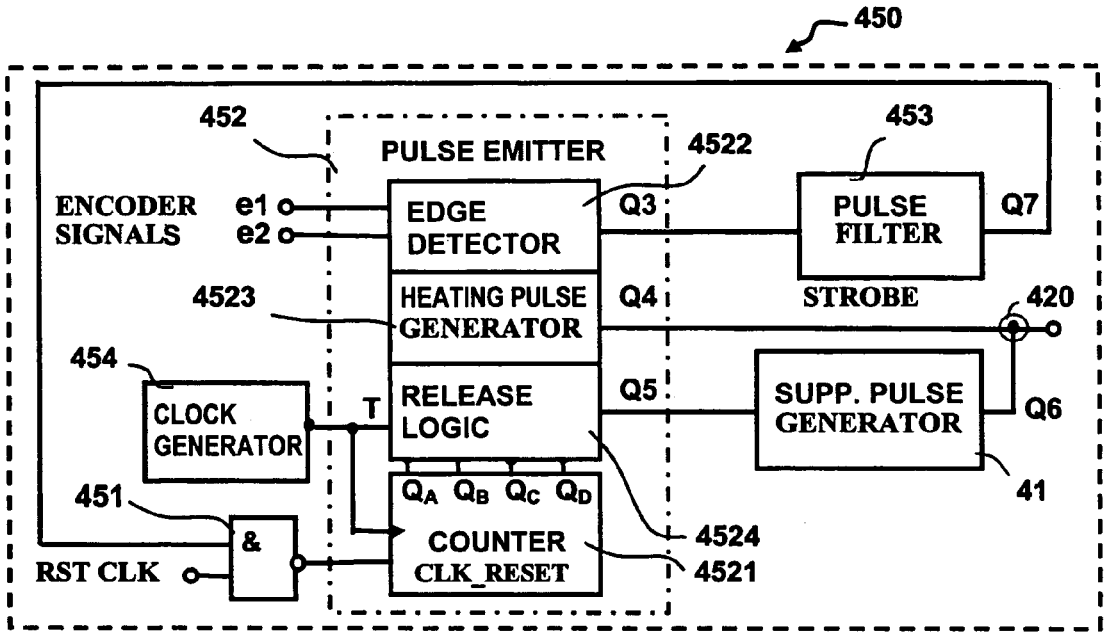
FIG. 3*a* shows a circuit in accordance with the invention with components to determine a delay and to control the supplementary pulse generator.

FIG. 3*a* shows a circuit arrangement with a unit to determine a transport delay and to control the supplementary pulse generator. A pulse emitter 452 that is charged on the input side with the encoder signals, clock generator signal and a reset signal, provides an encoder pulse series at its first output Q3, strobe pulses at its second output Q4 and a release pulse at its third output Q5 given a transport delay. The pulse emitter 452 is, for example, a component of a hardware circuit and has a counter 4521, an edge detector 4522, a heat pulse generator 4523 and release logic 4524. The counter 4521 is connected with its reset input at the output of a logic gate 451 and has a clock input connected with a clock generator 454. In the preceding exemplary embodiment, the clock generator 454 already emits a pre-divided clock signal and the counter 4521 emits (at its four outputs QA, QB, QC and QD) a binary code for the number of the counted clock pulses since a reset of the counter. The clock generator 454 can be omitted and the number of the counter outputs can be greater than four when a clock signal of the microprocessor 6 of the controller on the main board is used. The logic gate 451 is, for example, a NAND gate that is charged at one input with a control signal RST_CLK and at its other input with a prepared encoder pulse signal that is emitted at the output Q7 of a pulse filter 453, The input of the pulse filter 452 is connected to the output Q3 of the edge detector 4522 and emits a short pulse at each edge change of the encoder pulses e1 and e2. This short pulse is used to reset the counter at each edge change of the encoder pulses. The pulse filter 453 contains an analog or digital element that suppresses spikes and other interferences in the encoder pulse series. The logic gate 451 alternatively can be an AND gate when the counter type that is used requires this. In the simplest case, JK flip-flops are connected in series in the counter, and the output of the predecessor flip-flop is connected with an input of the successor flip-flop. The release logic 4524 logically links some of the outputs of the counter with the output of the clock generator 454 in order to generate further pulses as needed and in synchronization with the edge change of the encoder signals and can be fashioned, for example, such that it can be reprogrammed by the microprocessor 6. The heat pulse generator 4523 is likewise fashioned such that it can be programmed by the microprocessor 6 and emits at its output Q4 strobe pulses that arrive as heat pulses at the respective thermo-printing heating elements of the thermotransfer print head activated for printing. The release logic 4524 emits at the output Q5 a release signal to release a supplementary pulse generator 41. The output Q4 of the heat pulse generator 4523 and the output Q6 of the supplementary pulse generator 41 are, for example, logically connected with one another on the output side via a wired OR gate 420 in the embodiment shown in FIG. 3*a* (as an alternative to the variant with OR gate 42 shown in FIG. 2). This requires an open collector output in the supplementary pulse generator 41 and in the heat pulse generator 4523. The additional OR gate 42 thus can be omitted. A further difference of the embodiment relative to the embodiment shown in FIG. 2 is in the feed of two-encoder signals e1 and e2.

A further embodiment of the pulse generator 452 and of an encoder type is also conceivable, for example with an integrated edge detector. In the event that (dependent on the encoder type that is used) only a single encoder signal is provided that already corresponds with the necessary encoder pulse series which occurs at the output Q3 and (if applicable) Q7, the edge detector 4522 and, if applicable, the pulse filter 453 then can be omitted in the circuit arrangement 450. The generated pulse level and the logic type (positive or negative logic) conform to the logic of the thermotransfer print head type that is used. For example, more than one strobe signal can be generated in order to activate the thermo-printing heating elements grouped in the row 14.

A number of variants of the circuit arrangement 450 are possible to determine a transport delay and to control the supplementary pulse generator. An embodiment as a hardware circuit is necessary in order to improve the execution time. A field programmable gate array chip (FPGA chip) and other programmable logic ICs are suitable for this. An FPGA is an integrated circuit that comprises multiple thousand identical logic cells as standard components (up to 50,000 in the XC2S50 by the firm XILINX). Each logic cell can independently assume any of a limited set of states. The individual cells are interconnected by a matrix of the wires and the programmable switches. The design of a user is introduced in that the simple logic function is specified for each cell and the switches are selectively closed in the linkage matrix. Complicated designs are generated in that these fundamental blocks are combined in order to generate the desired circuit. These blocks form field-programmable means whose advantageous function is that the latter is defined by a program of the user instead of by the manufacturer of the device. The program is either permanently or semi-permanently burned in as a part of a board assembly process or is loaded from an external storage at each time when the aforementioned printing device is activated. The configuration data for the FPGA XC2S50 encompass approximately 0.6 Gbit and are stored in the fixed value storage FLASH 9 (FIG. 2). The use of an FPGA chip and connected technologies offers the advantage that the programmable logic saves development costs and time relative to an increasingly complicated ASIC design, whereby the gate count per FPGA chip has in the meantime achieved numbers which allow the implementation of ever more complicated applications. This allows a large degree of programmer freedom in hardware and software, whereby CAD tools mutually decide which parts of a source code program should be executed in software and which parts should be executed with hardware.

Furthermore, the circuit arrangement 450 can be realized with conventional technology as a hardwired circuit of logic gates of positive and/or negative logic.

Figure 3B:
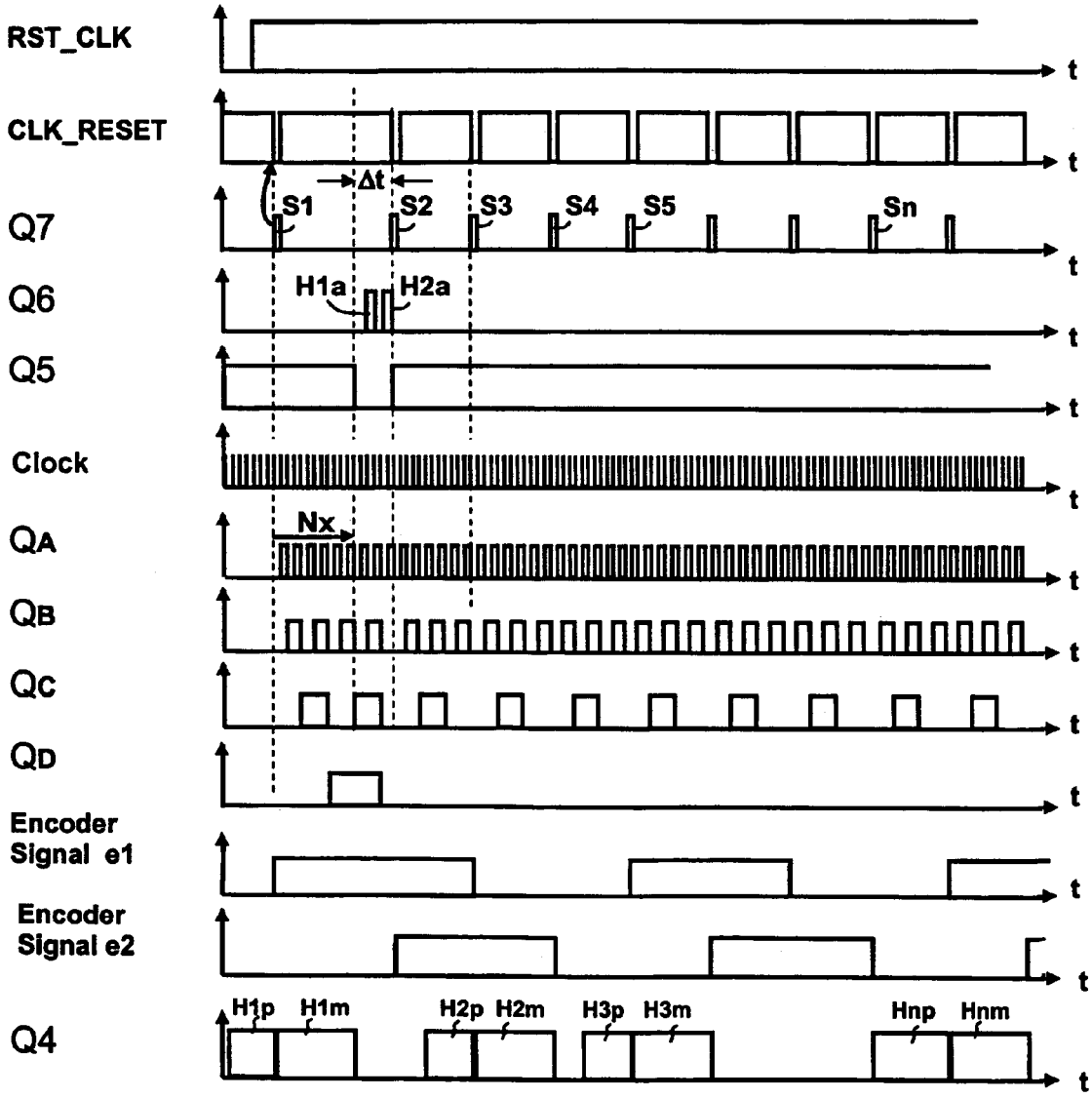
FIG. 3*b* is a pulse/time diagram of the circuit arrangement in accordance with the invention.

Pulse/time diagrams of the circuit arrangement 450 are shown in FIG. 3*b*. The heat pulse generator 4523 generates at its output Q4 pre-heating pulses H1*p*, H2*p*, H3*p*, . . . Hnp and respective subsequent main heating pulses H1*m*, H2*m*, H3*m*, . . . Hnm (last diagram for FIG. 3*b*). In the event that a print request exists for the corresponding resistance heating element in the print head and the pre-heating temperature has been reached, a main heating pulse is started in a series of an edge change of the encoder signals. A shorter pulse S1 is derived from the edge change (encoder pulse series at the output Q7). The release logic can establish the overrun of a predetermined counter state Nx and therewith a transport delay and thereupon generate a signal at the output Q5 suitable for control of the supplementary pulse generator (see fifth diagram of FIG. 3*b*).

The third diagram of FIG. 3*b* shows that the second short pulse S2 of the encoder pulse series occurs delayed by Δt at the output Q7, which characterizes a short-term transport delay. In contrast, the third short pulse S3 and further pulses Sn of the encoder pulse series occur without delay at the output Q7, meaning that the transport delay has ceased.

The counter is started after the occurrence of the first H/L edge of the CLK_RESET signal and upon occurrence of an H-level of the RST_CLK signal, which emerges from the first diagram of FIG. 3*b*. A clock signal is supplied to the counter, which can be seen from the sixth diagram of FIG. 3*b*. The pulse series at the outputs of the counter emerge from the seventh through tenth diagrams of FIG. 3*b*. From the signal levels at the outputs of the counter, the release logic generates an L-signal at the output Q5, which emerges from the fifth diagram of FIG. 3*b*. The supplementary pulse generator is active and generates supplementary heating pulses H1*a*, H2*a*, . . . during the occurrence of the L-signal, which emerges from the fourth diagram of FIG. 3*b*. The encoder signals e1 and e2 are shown in the eleventh and twelfth diagram. A reset of the counter via an H/L edge ensues delayed due to the transport delay, which can be seen from the second diagram of FIG. 3*b*. This leads to a larger interval between the first main heating pulse H1*m* and the second pre-heating pulse H2*b* than is desired.

Figure 4A:
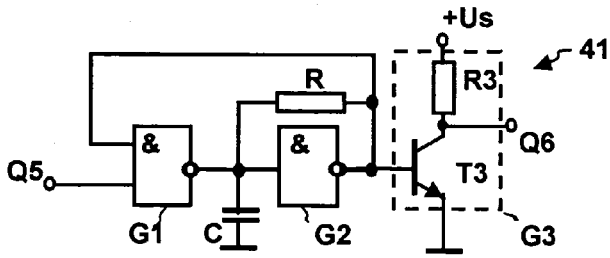
FIG. 4*a* is a circuit for a supplementary pulse generator in accordance with the invention.

FIG. 4*a* shows a circuit arrangement for a supplementary pulse generator 41. A capacitor C is switched between ground potential and the output of a first gate G1 and charges up to a threshold above a resistance R, whereby a downstream second gate G2 switches upon of the threshold being exceeded. The gates, for example, can be NAND gates in TTL technology or can be fashioned as Schmidt triggers. An inverter that, for example, is fashioned as a third gate G3 or an npn transistor T3 in the emitter circuit is connected at the output of the second gate G2. Its collector resistance R3 is connected at an operating voltage +Us and can be eliminated in the case of a wired-OR link. The output of the second date G2 is directed back to a first input of the first gate G1 whose second input is charged with the Q5 signal.

Figure 4B:
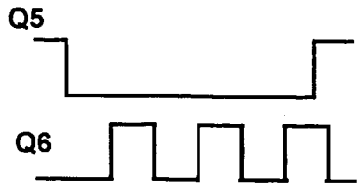
FIG. 4*b* is a pulse/time diagram for supplementary pulses for the circuit of FIG. 4*a*.

A pulse/time diagram for supplementary pulses at the output Q6 and for the Q5 signal at the first input of the first gate G1 of the supplementary pulse generator 41 is shown in FIG. 4*b*.

Figure 5:
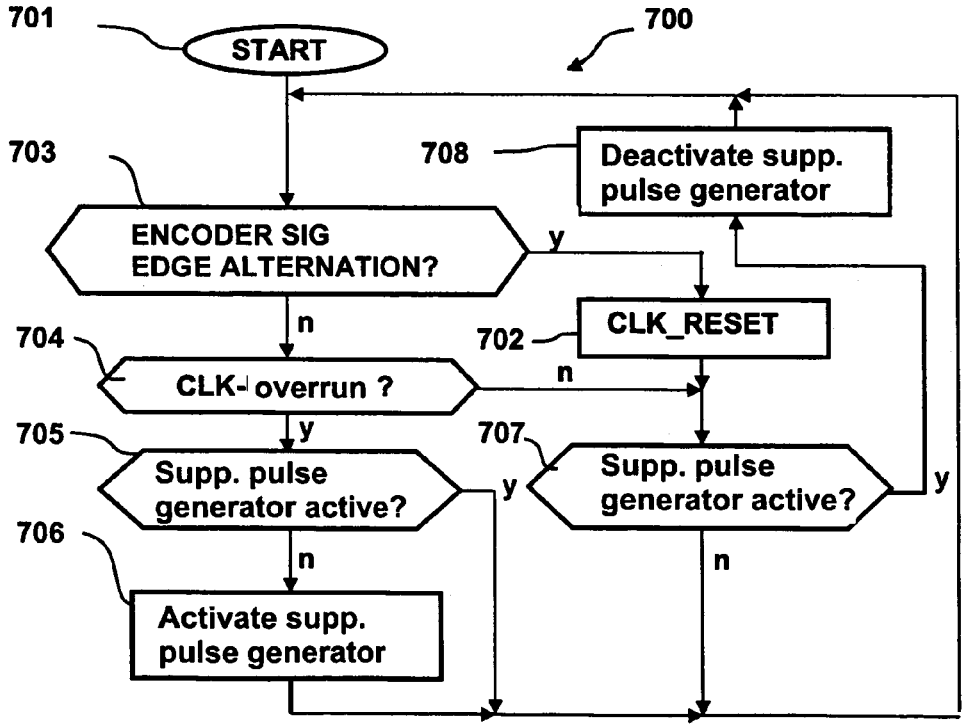
FIG. 5 is a flowchart for a unit to determine a transport delay and to control the supplementary pulse generator in accordance with the invention.

A flowchart for the unit to determine a delay and to control the supplementary pulse generator is shown in FIG. 5. Even when the pulse emitter is designed in part different than as shown in FIG. 3*a*, its should exhibit the function (expired in the flowchart) that corresponds to the following method 700: After the start in the step 701, a first query step 703 is reached in order to establish an encoder edge change. If the latter has not yet occurred, a second query step 704 is branched to in order to establish a CLK overrun of the counter or the overrun of a predetermined counter state. If the answer is no, i.e. the latter has not occurred, a fourth query step 707 is reached in order to establish whether the supplementary pulse generator is active. If the answer is then no, i.e. the latter is not active, the method then branches back to the first query step 703.

However, if an encoder edge change has occurred, a step 702 (reset of the counter) is then branched to. The fourth query step 707 is then reached again. If the answer is then no again, i.e. the supplementary pulse generator is not active, the method then branches back to the first query step 703.

However, given a transport delay no encoder edge change occurs before reaching a predetermined counter state or, respectively, overrun. The response to the first query step 703 is then no and the second query step 704 is reached again. If a CLK overrun of the counter or the overrun of a predetermined counter state is now established, the response is then "yes" and a third query step 705 is reached in order to establish whether the supplementary pulse generator is active. If the answer is no, i.e. the latter is inactive, a step 706 is then reached and the supplementary pulse generator is activated. The method subsequently branches back to the first query step 703.

If the response given at the third query step 705 is "yes," i.e. the latter is active, the method then likewise branches back to the first query step 703.

If the response given at the fourth query step 707 is "yes," i.e. the latter is active, a step 708 for deactivation of the supplementary pulse generator is then reached. The method subsequently again branches back to the first query step 703.

Figures 6A, 6B, 6C, 7A, 7B, 7C, 7D, 8A, 8B, 8C, 8D, 9A, 9B, 9C, 9D:
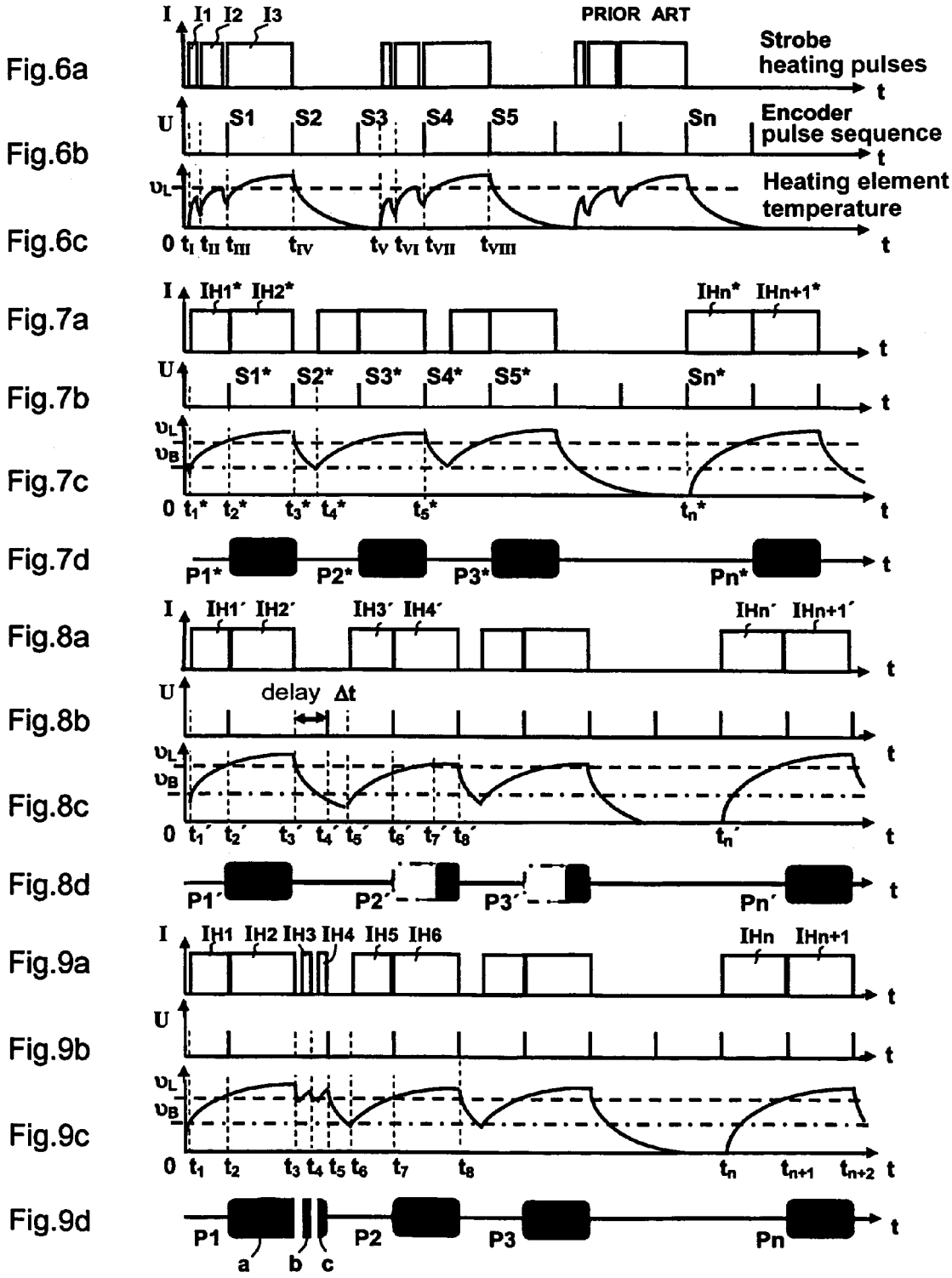
Fig.9d PRIOR ART
FIG. 6*a* is a pulse/time diagram for a slow printing of a series of print pulses (prior art).
FIG. 6*b* is a pulse/time diagram of an associated encoder pulse series.
FIG. 6*c* is a temperature/time diagram at a heating element for slow printing of a series of print pulses.
FIG. 7*a* is a pulse/time diagram for fast printing of a series of print pulses in the ideal case.
FIG. 7*b* is a pulse/time diagram of an associated encoder pulse series.
FIG. 7*c* is a temperature/time diagram at a heating element for fast printing of a series of print pulses.
FIG. 7*d* is a pixel/time diagram for fast printing of a series of print image points.
FIG. 8*a* is a pulse/time diagram for fast printing of a series of print pulses, with a transport delay.
FIG. 8*b* is a pulse/time diagram of an associated encoder pulse series.
FIG. 8*c* is a temperature/time diagram of a heating element for fast printing of a series of print pulses and with compensation of the effect that is caused by the transport delay.
FIG. 8*d* is a pixel/time diagram for fast printing of a series of print image points with a transport delay.
FIG. 9*a* is a pulse/time diagram for a series of print pulses and with compensation of the effect that is caused by the transport delay.
FIG. 9*b* is a pulse/time diagram of an associated encoder pulse series.
FIG. 9*c* is a temperature/time diagram at a heating element for a series of print pulses and with compensation of the effect that is caused by the transport delay.
FIG. 9*d* is a pixel/time diagram for a series of print image points given compensation of the effect that is caused by the transport delay.

FIG. 6*a* shows a pulse/time diagram for a slow printing of a series of print pulses (prior art). In the slow printing, speed deviations in the mail piece transport speed have a less interfering effect in the print image than given a fast printing of a series of print image points. It is therefore sufficient to correct a possible deviation from a desired speed before or, respectively, after the printing and, during the printing, to act on the assumption of an average transport speed when the pulse duration of the heating pulses of the strobe signal is determined. The supplementary current pulses 11 and 12 temporally precede a main current pulse 13 that heats a heating element and causes (via a thermotransfer ink ribbon) the imprint of a dot on a mail piece. Such a series of current pulses of growing pulse width for loading of a resistance-heating element are known from European Patent EP 53 65 26.

FIG. 6*b* shows a pulse/time diagram of an associated encoder pulse series. The temporal separation of the adjacent pulses S1 through Sn of the encoder pulse series reproduces the present mail piece transport speed. Each associated main current pulse is therefore synchronized with a pulse S1 through Sn of the encoder pulse series.

FIG. 6*c* shows a temperature/time diagram at a heating element for slow printing of a series of print pulses. The supplementary current pulses I1 and I2 are started at the points in time $t_I$ and $t_{II}$ and temporally precede a main current pulse 13 that is started at the point in time $t_{III}$. A notable temperature decline ensues at the end of each heating current pulse, which leads to a sawtooth-like temperature curve. Since the temperature limit value $\cup_L$ should only be exceeded by the main current pulse I3, problems result in the adjustment of the printing parameter.

A pulse/time diagram for a fast printing of a series of printing pulses (in the ideal case) by a single resistance heating element is explained using FIG. 7*a*. Only a single pre-heating current pulse IH1*, . . . , IHn* respectively, temporally precedes each main heating current pulse IH2*, . . . , IHn+1*. The pulse intervals between the pre-heating current pulse and the subsequent main heating current pulse, and the pulse intervals between the preceding main heating current pulse and the pre-heating current pulse of the respective subsequent main heating current pulse, are reduced. The interval between the main heating current pulses IH2*, . . . , IHn+1* has been reduced in order to achieve a higher print resolution in the transport direction.

FIG. 7*b* shows a pulse/time diagram of an associated encoder pulse sequence. The temporal interval of the adjacent pulses S1* through Sn* of the encoder pulse sequence reproduces the achievable resolution for a determination of the current mail piece transport speed. The printing speed is uniform and constant. Each associated main current pulse is again respectively synchronized with a pulse S1* through Sn* of the encoder pulse sequence.

The temperature/time diagram shown in FIG. 7*c* reproduces the temperature curve at a single heating element for fast printing of a series of print pulses. A smoother rising temperature curve (that has been shown idealized) is achieved via reduction of the pulse interval between the pre-heating current pulse and subsequent main heating current pulse. The temperature limit value UL is only exceeded by the main current pulse IH2*, . . . , IHn+1*. A temperature drop to the value of the operating temperature $\cup_B$ is only temporarily allowed after each main current pulse, whereby a subsequent pre-heating current pulse allows (via its pre-heating effect) the temperature limit value $\cup_L$ to be approximately reached again. Given longer pauses without print requirement at a heating element, it is possible that further pre-heating pulses must be generated in order to counteract a cooling.

However, such pre-heating pulses (not shown) only allow the value of the operating temperature $\cup_B$ to be reached and do not lead to a printing of a dot.

A pixel/time diagram for a fast printing of a sequence of print image points is shown in FIG. 7*d*, wherein the printing speed is uniformly constant and no transport delay occurs. A pixel P1* through Pn* to be printed is the smallest data unit that characterizes an object in a computer graphic and shows in color (black). Given higher printing speeds, corresponding measures are taken not only for pre-distortion of the printing pattern but rather also for pre-distortion of the time duration of the pixel for printing of each individual dot.

FIG. 8*a* shows a pulse/time diagram for fast printing of a series of print pulses and given a transport delay. Due to a transport delay, a larger temporal gap is created between the main heating current pulse IH2' and the subsequent pre-heating current pulse IH3' of the main heating current pulse IH4' than between the main heating current pulse IH4' and the subsequently pre-heating current pulse IH5' of the main heating current pulse IH6'. A temperature decrease at the heating element, which has an interfering effect for the further printing, can be measured via a delayed encoder pulse after the first printed print image point.

FIG. 8*b* shows a pulse/time diagram of an associated encoder pulse sequence with transport delay Δt that becomes noticeable as a delay of the second pulse of the encoder pulse sequence.

FIG. 8*c* shows a temperature/time diagram at a heating element for a fast printing of a series of print pulses. A non-uniform transport speed leads to a delayed encoder pulse. The transport delay $\Delta t = t_5' - t_3'$ between the pulses IH2' and IH3' has the effect of an unwanted cooling that occurs for such a short term that it cannot be compensated by a regulation of the transport speed during the printing.

A pixel/time diagram for a fast printing of a series of print image points and given a transport delay is shown in FIG. 8*d*. A pre-distortion of the pixels should preclude a compression of the shape in the transport direction during the printing. In spite of the pre-distortion of the time duration of the printing of each individual dot, a first pixel P1' elongated in the time axis direction during the printing is printed (FIG. 1) as a compressed dot D1' because, given a transport delay, the printing of a dot is ended earlier than the transport via the associated transport path. In addition, a second pixel P2' is first printed at a point in time t7' instead of at a point in time t6' since the temperature limit value $\cup_L$ has not been achieved by pre-heating. The second pixel P2' should exhibit the dash-dot shape, however has only the colored (blackened) shape. This is likewise true for a third pixel P3'. Only after a time duration (printing pause; required by a corresponding regulation) is the operating temperature achieved again by means of a number of pre-heating pulses or a pre-heating pulse with sufficient pulse duration, such that a further pixel Pn' elongated in the time axis direction is printed during the printing as a circular dot Dn' (FIG. 1).

FIG. 9*a* shows a pulse/time diagram for a series of print pulses and with compensation of the effect that is caused by the transport delay. The printing of the first dot is expanded up to the point in time $t_5$ via additional heating pulses IH3' and IH4' between the point in times $t_3$ and $t_5$.

FIG. 9*b* shows a pulse/time diagram of an associated encoder pulse sequence with a delay as shown in FIG. 8*b*.

FIG. 9*c* shows a temperature/time diagram at a heating element for a series of print image points to be printed. A compensation of the effect of the transport delay ensues in that, during the printing, the temperature is raised above the temperature limit value $\cup_L$ via additional heating pulses IH3' and IH4' not only between the points in time $t_2$ and $t_3$ but rather moreover between the points in time $t_3$ and $t_4$ as well as $t_4$ and $t_5$.

A pixel/time diagram for a series of print image points is shown in FIG. 9*d*. The first pixel P1 is extended in the transport direction, whereby the temperature decline in the heating element that is otherwise caused by the transport delay is compensated. The first pixel P1 has a part a that is caused by a main heating pulse. The first-pixel P1 moreover has parts b and c caused by a supplementary heating pulse.

The effective total length of the print pulses conditional upon a main heating pulse and supplementary heating pulses is extended across the provided raster point in time when a print requirement exists and a transport delay is established. The length of a print pulse is thereby always smaller than the separation of the raster points in time from one another.

The length of the pause between the print pulses immediately separated from one another is variable during the printing, and is established dependent on the resistance value of a thermo-printing element on the environment temperature on the print parameters.

Alternatively, the length of the print pulses can be variable dependent on at least one of the aforementioned parameters. In particular, the length of the supplementary heating pulses or of the pause between the supplementary heating pulses can be variable dependent on at least one of the aforementioned parameters. For this, the supplementary heating pulse generator 4523 (FIG. 3*a*) is fashioned such that it can be controlled or adjusted by the microprocessor 6. Alternatively, for example, the resistance R of the supplementary heating pulse generator 41 (FIG. 4*a*) or 4523 (FIG. 3*a*) can be replaced by a current source (not shown) controllable by the microprocessor 6. Setting data are transmitted by the microprocessor 6 at least before each activation of the supplementary heating pulse generator 41 or 4523.

Given a low resistance value of a thermo-printing heating element, more energy is supplied during the pulse duration given a constant voltage. The pulse pause length between the print pulses immediately separated from one another is thus to be selected larger than given a higher resistance value.

Given a higher environment temperature, a lower energy supply is sufficient for temperature maintenance at the thermo-printing heating elements. Alternatively, the initial print head temperature at the point in time of the activation of the printing device can be stored as an environment temperature. During the operation, only the temperature inside the cartridge tray of the thermotransfer ink ribbon cartridge is of interest. This is a function of the initial print head temperature and print head operating temperature. The properties of the ink on the thermotransfer ink ribbon of the thermotransfer ink ribbon cartridge likewise yield an influence on the printing parameters current pulse height and current pulse duration given constantly regulated voltage amplitude.

Figure 10A:
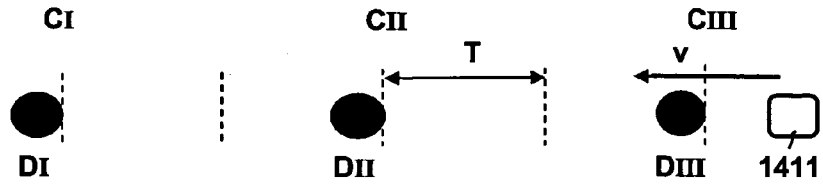
FIG. 10*a* shows a detail of the print pattern according to FIG. 1 for uniform slow printing of a series of print image points by a heating element

FIG. 10*a* shows a detail of the print pattern according to FIG. 1 for a uniformly slow printing of a series of print image points by a thermo-printing heating element 1411 on a print medium surface. The print medium (envelope, ribbon) is moved with a transport speed v under the first thermo-printing heating element 1411 which is heated such that a dot DI, DII and DIII is successively printed in each of the print columns C1, CII and CIII via the thermotransfer ink ribbon.

Figure 10B:
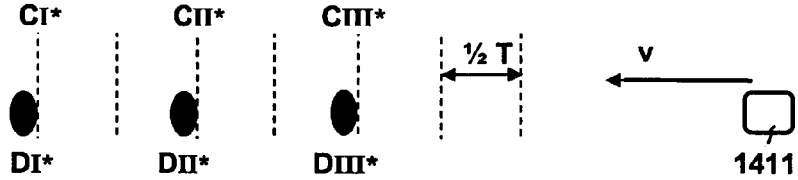
FIG. 10*b* shows a detail of the print pattern according to FIG. 1 for uniform fast printing of a series of print image points by a heating element.

FIG. 10*b* shows a detail of the print pattern according to FIG. 1 for a uniformly fast printing of a series of print image points by a heating element. By halving the clock period T and the time duration both for each heating pulse and for each pulse pause, a doubling of the printing speed is possible, although not only the print image but rather also all dots are reproduced compressed in the transport direction (arrow) of the print medium (not shown). The transport speed v remains unchanged and was selected as in FIG. 10*a*. Due to the reduction of all pulse pauses and print durations of the thermo-printing heating element 1411, compliance with the time regime is more difficult. For equalization of the dots in the transport direction, both the print duration and the pulse duration for pre-heating pulses must be lengthened again to load the pulse pauses.

A dot DI*, DII* and DIII* are each printed in series in the printing columns CI*, CII* and CIII*. A doubling of the print resolution in the transport direction is possible via this measure, but enough time must be provided for the equalization of the dots in the transport direction.

However, in a further variant no equalization of the dots is implemented and the transport speed v is changed and, for example, doubled to 2v. A print pattern detail—as shown in FIG. 10*a*—is thus achieved and the doubling of the print resolution in the transport direction is compensated by the transport speed doubled to 2v.

Figure 10C:
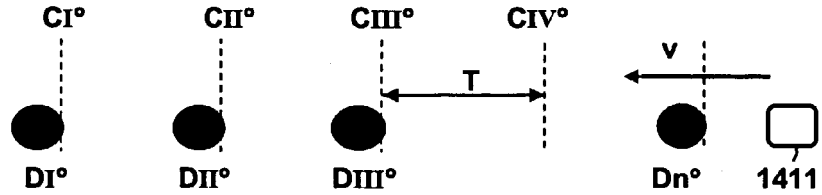
FIG. 10*c* shows a detail of the print pattern according to FIG. 1 for uniform slow printing of a series of closely adjacent print image points by a heating element.

FIG. 10*c* shows a detail of the print pattern according to FIG. 1 for a uniformly slow printing of a series of narrowly adjacent print image points by a heating element. With this measure a doubling of the print resolution is possible in the transport direction, whereby however additional dots must be provided in the transport direction. The transport speed v remains unchanged and was selected as in FIG. 10*a*. A dot DI°, DII°, DIII° and Dn° is each printed in series in the print columns CI°, CII°, CIII° and Cn° via thermotransfer ink ribbon. In the present example, only in the print column CIV° is no dot printed.

Figure 10D:
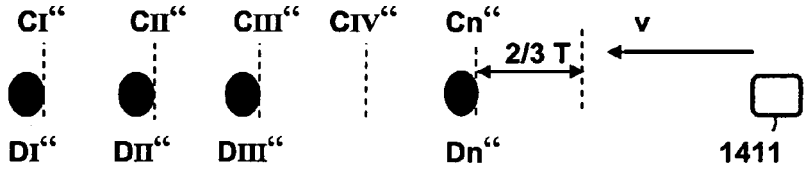
FIG. 10*d* shows a detail of the print pattern according to FIG. 1 for uniform fast printing of a series of closely adjacent print image points by a heating element.

FIG. 10*d* shows a detail of the print pattern according to FIG. 1 for a uniformly fast printing of a series of narrowly adjacent print image points by a heating element. The clock period now amounts to, for example, ⅔ T. The transport speed v remains unchanged and was selected as in FIG. 10*a*. A dot DI", DII", DIII" and Dn" is each printed in series in the print columns CI", CII", CIII" and Cn" via thermotransfer ink ribbon. In the present example, only in the print column CIV" is no dot printed. The print resolution was increased by 1.5 times with this measure, and the deformation of the dots remains minimal. This achieves an equalization of the dots.

However, in a further variant no equalization of the dots is implemented and the transport speed v is changed and, for example, increased to 1.5v. A print pattern detail—as shown in FIG. 10*c*—is thus again achieved and the improvement of the print resolution in the transport direction via a clock period of the value ⅔ T is again compensated by the transport speed increased to 1.5v. The doubling of the horizontal resolution achieved in FIG. 10*c* is thus maintained given 1.5 times the transport speed.

The vertical print resolution is now likewise increased by the 1.5 times the value, in that the number of the thermo-printing heating elements is increased from 240 to 360 in the row 14 of the print head. Upon printing, only 305 thermo-printing heating elements are activated, such that the vertical print resolution is 305 dots per inch.

Figure 10E:
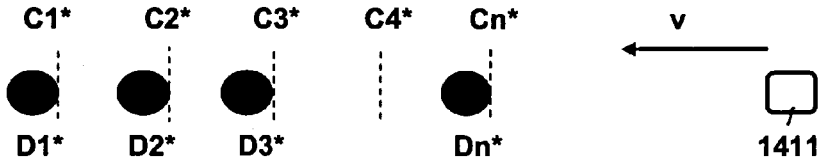
FIG. 10*e* shows a detail of the print pattern according to FIG. 1 for uniform fast printing of a temporally pre-distorted series of closely adjacent print image points by a heating element.

FIG. 10*e* shows a detail of the print pattern according to FIG. 1 for a uniformly fast printing of a temporally pre-distorted series of narrowly adjacent print image points via a heating element. An equalization of the dots of the print pattern detail relative to FIG. 10*d* is achieved without variation of the transport speed v. The transport speed v remains unchanged and was selected as in FIG. 10*a*. A dot D1*, D2*, D3* and Dn* is each printed in series in the print columns C1*, C2*, C3* and Cn* via thermotransfer ink ribbon. In the present example, only in the print column C4* is no dot printed. A uniform print pattern—as is shown in principle in FIG. 1 in the field 3—is, however, achieved only given a uniform transport of mail pieces.

Figure 10F:
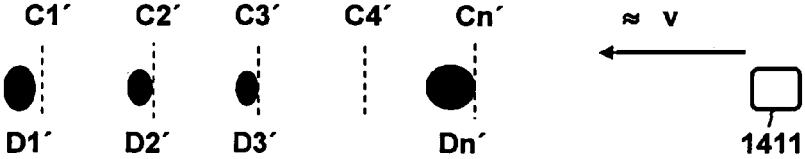
FIG. 10*f* shows detail of the print pattern according to FIG. 1 for non-uniform fast printing of a series of closely adjacent print image points by a heating element.

FIG. 10*f* shows a detail of the print pattern according to FIG. 1 for a non-uniformly fast printing of a series of narrowly adjacent print image points by a heating element. A variation of the transport speed v is not provided.

A dot D1', D2', D3' and Dn' is each printed in series in the print columns C1', C2', C3' and Cn' via thermotransfer ink ribbon. In the present example, only in the print column C4' is no dot printed. The effect of the transport delay has already been explained using the example according to FIG. 8. The printed point D1' lies next to the print columns C1' and the size of the dots D2', D3' are reproduced compressed in the print columns C2' and C3' in the transport direction (arrow) of the print medium (not shown).

Figure 10G:
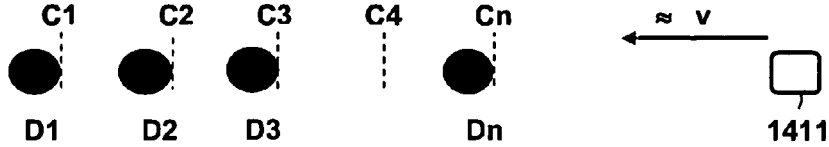
FIG. 10*g* shows a detail of the print pattern according to FIG. 1 for non-uniform fast printing of a series of closely-adjacent print image points by a heating element, with compensation of the effect due to a delayed encoder pulse.

FIG. 10*g* shows a detail of the print pattern according to FIG. 1 for a non-uniformly fast printing of a series of narrowly-adjacent print image points by a heating element with compensation of the effect via a delayed encoder pulse. A dot D1, D2, D3 and Dn is each printed in series in the print columns C1, C2, C3 and Cn via thermotransfer ink ribbon. In the present example, only in the print column C4 is no dot printed. The detail of the print pattern resembles the ideal case of FIG. 10*e*. A variation of the transport speed v is not provided. The measure explained above allows an error-free printing with a horizontal print resolution of over 600 dpi. The vertical print resolution likewise can be increased by the corresponding value, in that a print head type is used in which the number of thermo-printing heating elements is increased to over 600 in the print row 14 of the print head arranged orthogonal to the transport direction.

Relative to the thermotransfer machines by the applicant if the type T1000 and Optimail, which achieve 200 dpi, either the print resolution thus can be increased to 305 dpi and the transport speed can be increased by 1.5 times or, given the same transport speed, the print resolution can be tripled to over 600 dpi.

Although modifications and changes may be suggested by those skilled in the art, it is the intention of the inventor to embody within the patent warranted hereon all changes and modifications as reasonably and properly come within the scope of his contribution to the art.

I claim as my invention:

1. For a thermotransfer print head having a plurality of thermo-printing heating elements that are individually activatable to print information on a medium transported passed said thermotransfer print head, the improvement of an arrangement for activation of said thermo-printing heating elements of said thermotransfer print head comprising:

a unit that determines a transport delay in transporting said medium relative to said thermotransfer print head;

a unit that generates supplementary heating pulses to maintain a printing temperature at said thermo-printing heating element; and said unit for determining a transport delay being connected to said thermotransfer print head through said unit for generating supplementary heating pulses.

2. An arrangement as claimed in claim 1 wherein said unit to determine a transport delay comprises a pulse emitter having inputs adapted to receive encoder signals indicative of said transport delay, said pulse emitter emitting a pulse indicative of said delay, dependent on said input signals, and wherein said unit to generate supplementary heating pulses comprises a supplementary pulse generator connected to said pulse emitter that is triggered by said pulse indicative of said transport delay to emit said supplementary heating pulses.

3. An arrangement as claimed in claim 2 wherein said pulse emitter comprises a heating pulse generator that emits a heating pulse sequence, dependent on said encoder signals, in an absence of said transport delay, said heating pulse generator having an output connected to an output of said supplemental pulse generator at which said heating pulse sequence is augmented with said supplementary heating pulses.

4. An arrangement as claimed in claim 2 wherein said unit to determine a transport delay comprises a clock generator that emits clock pulses, and reset logic, and wherein said pulse emitter comprises an edge detector that detects each H/L and L/H edge alternation in said encoder signals, a counter having a clock input that receives said clock pulses from said clock generator and a reset input connected to an output of said reset logic, and release logic connected to said supplementary pulse generator having an output at which said pulse indicative of said transport delay is emitted, said edge detector emitting pulses to said reset logic dependent on said edge alternations in said encoder signal and said reset logic resetting said counter dependent thereon, said counter accumulating a count of said clock pulses after being reset by said reset logic, and said release logic emitting said pulse indicative of a transport delay if no edge alternation is detected before an overrun of said counter, or if a predetermined count of said counter is exceeded.

5. An arrangement as claimed in claim 4 wherein said unit for determining a transport delay comprises a pulse filter connected to an output of said edge detector, said pulse filter generating a short pulse upon each edge alternation of said encoder signals detected by said edge detector, and said reset logic having a first input connected to an output of said pulse filter and a second input supplied with a reset clock, said reset logic performing a NAND operation on the output of said pulse filter and said reset clock.

6. An arrangement as claimed in claim 5 wherein said clock generator emits a pre-divided clock signal, and wherein said counter comprises a plurality of outputs connected to said release logic via which a binary code, representing an accumulated number of said clock pulses since a reset of said counter, is supplied to said release logic.

7. An arrangement as claimed in claim 5 wherein said pulse filter suppresses components in the output of said edge detector representing spikes and interferences in said encoder signals.

8. An arrangement as claimed in claim 5 comprising a printer controller for operating said print head, said printer controller comprising said unit to determine said transport delay and being connected to said unit to generate said supplementary heating pulses, and wherein said arrangement comprising a microprocessor connected to said printer controller further comprises a microprocessor, said counter and said release logic being reprogrammable by said microprocessor, and said microprocessor operating a processor clock signal, and comprising a logical linkage between the output of said counter and said processor clock signal, said logical linkage generating logical linkage output pulses for use in synchronizing other components with said edge alternations of said encoder signals.

9. An arrangement as claimed in claim 2 comprising a print data controller, containing said unit to determine a transport delay and said unit to generate supplementary heating pulses, connected to said thermotransfer print head, and a microprocessor connected to said print data controller, said print data controller being programmable by said microprocessor to emit strobe pulses to respective thermo-printing heating elements of said thermotransfer print head that have been activated for printing, and wherein said print data controller comprises a heating pulse generator that emits a heating pulse sequence at an output thereof, and wherein said print data controller comprises a logical OR combination of the outputs of said supplemental pulse generator and said heating pulse generator that produces said strobe signal from said outputs of said supplement pulse generator and said heating pulse generator.

10. An arrangement as claimed in claim 9 wherein said print data controller comprises a printer controller containing said unit to determine a transport delay, and an encoder that generates said encoded signals, said printer controller comprising a DMA controller, said print data controller comprising a pixel data preparation unit connected to said thermotransfer print head, and said arrangement comprising at least one storage unit connected to said pixel data preparation unit for supplying information to said pixel data preparation unit for printing by said thermotransfer print head, said DMA controller being connected to said microprocessor and to said pixel data preparation unit for organizing said information to be printed by said thermotransfer print head.

11. A method for activating respective thermo-printing heating elements of a thermotransfer print head to print information on a print medium being transported passed said thermotransfer print head, said method comprising the steps of:

automatically electronically determining an occurrence of a transport delay in transport of said print medium passed said print head; and dependent on determination of said transport delay, automatically electronically generating supplementary heating pulses to maintain a temperature at thermo-printing heating elements in said thermotransfer print head for which a printing requirement exists.

12. A method as claimed in claim 11 wherein the step of automatically electronically determining a transport delay comprises generating encoder signals indicative of transport of said print medium passed said thermotransfer print head, said encoder signals comprising edge alternations;

detecting said edge alternations in said encoder signals; and accumulating clock pulses in a counter, following a reset time dependent on said edge alternations, and determining that a transport delay has occurred if no edge detection is detected before an overrun of said counter, or if a predetermined count of said counter is exceeded.

13. A method as claimed in claim 12 comprising, after reset of said counter, the steps of:

determining whether an edge alternation in said encoder signals has been detected;

if no encoder edge alternation has been detected, determining whether said overrun of said counter has occurred or whether said predetermined count has been exceeded;

if neither said overrun nor said predetermined count has occurred, determining whether a supplementary pulse generator, that generates said supplementary heating pulses, is active;

if said supplementary pulse generator is not active, again determining whether an edge alternation has been detected and, if so, resetting said counter and again determining whether said supplementary pulse generator is active;

if said supplementary pulse generator is not active, again determining whether an edge alternation has been detected, and if no edge alternation has been detected, determining whether said overrun or said predetermined count has occurred;

if said overrun or said predetermined count has occurred, determining whether said supplementary pulse generator is active, and if said supplementary pulse generator is not active, activating said supplementary pulse generator and determining whether an edge alternation has been detected;

if said supplementary pulse generator is active, determining whether an edge alternation has been detected; and after resetting said counter, and in an absence of said overrun and an absence of exceeding said predetermined count, and if said supplementary pulse generator is active, deactivating said supplementary pulse generator.

14. A method as claimed in claim 11 comprising generating printing pulses for activating the respective thermo-printing heating element of said thermotransfer print head for which a print requirement exists and augmenting said printing pulses with said supplementary heating pulses generated by said supplementary pulse generator, and varying a duration of respective intervals between successive print pulses dependent on a resistance of a thermo-printing heating element and an environmental temperature.

15. A method as claimed in claim 14 comprising varying at least one of a duration of respective supplementary heating pulses or an interval between successive supplementary heating pulses, dependent on at least one of said resistance and said environmental temperature, and transmitting setting data representing said at least one of said resistance and said environmental temperature from a microprocessor to said supplementary pulse generator before activating said supplementary pulse generator.

* * * * *